United States Patent [19]

Enkegaard

[11] 4,419,964

[45] Dec. 13, 1983

[54] COMBUSTION PLANT

[75] Inventor: Torben Enkegaard, Copenhagen, Denmark

[73] Assignee: F. L. Smidth & Co., Cresskill, N.J.

[21] Appl. No.: 392,456

[22] Filed: Jun. 28, 1982

Related U.S. Application Data

[63] Continuation of Ser. No. 88,526, Oct. 26, 1979, abandoned.

[51] Int. Cl.[3] ..... F22B 1/00

[52] U.S. Cl. ..... 122/4 D; 110/216; 110/264

[58] Field of Search ..... 122/4 D; 110/263, 264, 110/244, 245, 216; 431/7, 170; 432/15

[56] References Cited

U.S. PATENT DOCUMENTS

| | | |
|---|---|---|
| 2,265,465 | 8/1941 | Turpin . |
| 2,529,366 | 11/1950 | Bauer . |
| 2,670,193 | 2/1954 | Pyzel . |
| 2,935,840 | 5/1960 | Schoppe . |
| 3,031,769 | 5/1962 | Wilson . |
| 3,102,092 | 8/1963 | Heath et al. . |
| 3,171,369 | 3/1965 | Stephen, Jr. et al. . |
| 3,275,140 | 9/1966 | Rasmussen . |
| 3,784,676 | 1/1974 | Moss . |
| 3,955,995 | 5/1976 | Toubourg . |
| 3,975,148 | 8/1976 | Fukuda et al. . |
| 3,997,288 | 12/1976 | Takaoka et al. . |
| 4,009,121 | 2/1977 | Luckenbach . |
| 4,025,295 | 5/1977 | Toubourg . |
| 4,072,130 | 2/1978 | Zenz . |
| 4,103,646 | 8/1978 | Yerushalmi et al. . |
| 4,127,406 | 11/1978 | Kreft et al. . |
| 4,177,742 | 12/1979 | Uemura et al. ..... 110/245 X |

FOREIGN PATENT DOCUMENTS

| | | |
|---|---|---|
| 50-121198 | 9/1975 | Japan . |
| 54-149275 | 11/1979 | Japan . |
| 54-149276 | 11/1979 | Japan . |
| 317470 | 7/1929 | United Kingdom . |
| 659882 | 10/1951 | United Kingdom . |
| 705447 | 3/1954 | United Kingdom . |
| 745552 | 2/1956 | United Kingdom . |
| 1510946 | 5/1978 | United Kingdom . |
| 1523886 | 9/1978 | United Kingdom . |

*Primary Examiner*—Edward G. Favors

*Attorney, Agent, or Firm*—Pennie & Edmonds

[57] ABSTRACT

A whirl chamber boiler plant for generation of steam includes a combustion chamber in which the fuel is burned in a whirl within the chamber. The bottom of the chamber slopes downwardly towards an inlet through which combustion air is admitted into the chamber. Fuel and inert material are admitted into the chamber adjacent the bottom thereof. The inlet is of a size suitable for fluidizing the inert material within the chamber. Boiler tubes built within the chamber provide for removal of heat from the chamber. Preferably the inert material is a grain-shaped ash of the type produced by the burning of the fuel. In one embodiment of the present invention, a portion of the ash contained in the gases exiting from the chamber is returned to the chamber.

19 Claims, 1 Drawing Figure

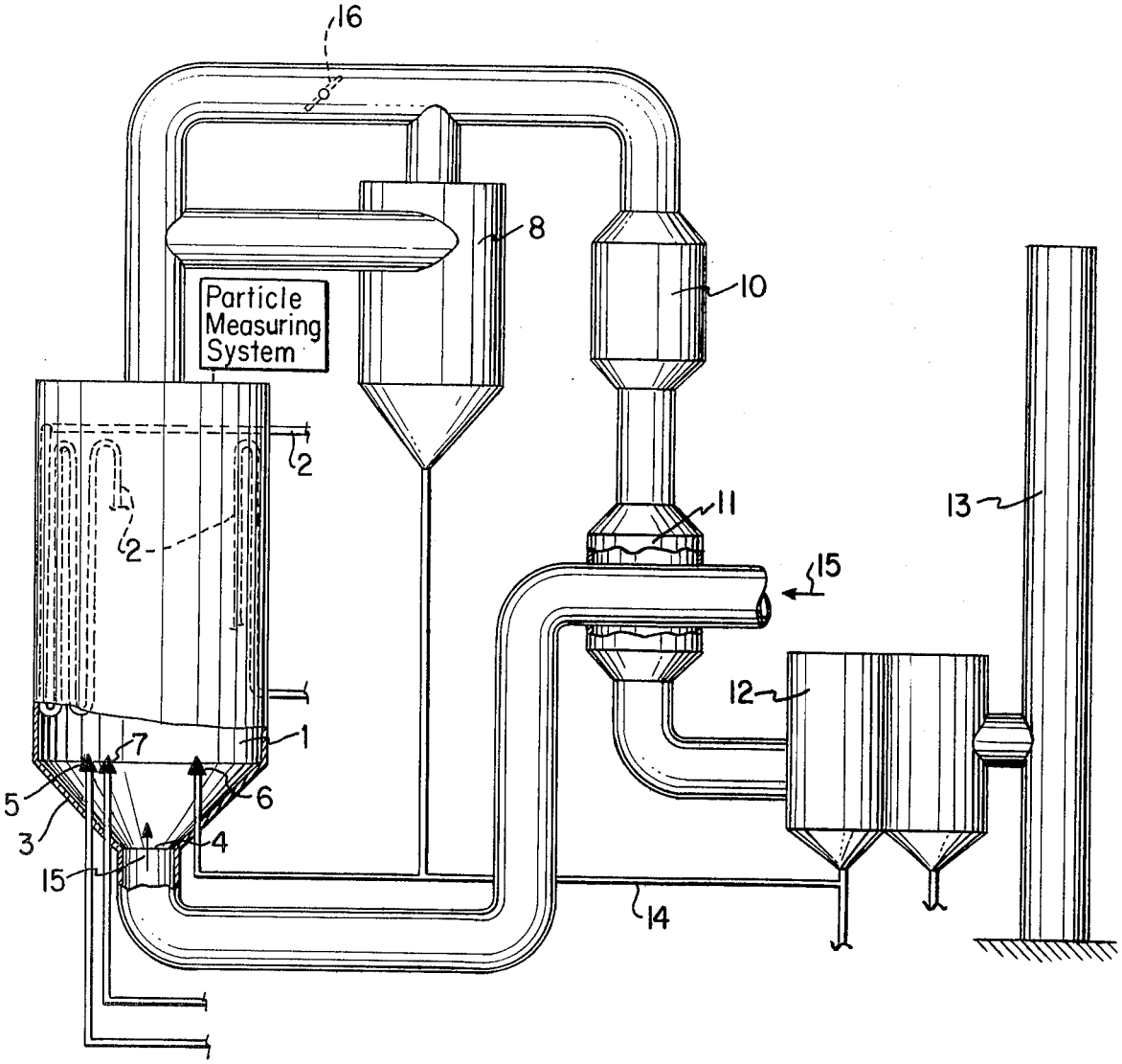
16
8
10
Particle
Measuring
System
2
2
11
13
15
12
1
7
5
6
3
4
15
14

COMBUSTION PLANT

This is a continuation of application Ser. No. 088,526, filed on Oct. 26, 1979 abandoned. Priority of application Ser. No. 4784/78 filed Oct. 27, 1978 in Great Britain is claimed under 35 U.S.C. §119.

TECHNICAL FIELD

This invention relates to an apparatus for combustion or a fuel while in suspension, and in particular to a steam boiler plant including a whirl chamber in which the fuel is suspended and burned.

BACKGROUND ART

Steam boiler plants in which the combustion of the fuel necessary for the generation of steam takes place in a fluidized-bed are known. In the fluidized-bed, the fuel is mixed with an inert, grain-shaped material, which does not itself participate in the combustion. The inert material serves to maintain an even distribution of the fuel on the fluidized-bed and to transfer the heat generated to heat absorbers, e.g. built-in heat absorbing boiler tubes. Also, at least part of the oxygen necessary for the combustion is taken from the fluidizing air between the inert material.

However, in fluidized-beds the bottom on which the fluidized material rests is disadvantageously rather complex, inasmuch as it is composed of a number of nozzles through which the fluidizing air is blown in. Such nozzles are likely to block up, and it calls for a considerable pressure drop over the nozzles in order to maintain an even air flow over the entire cross-section of the bed. This in turn results in a substantial loss of power. I have invented an improved whirl chamber type boiler plant which avoids the above-noted limitations of the prior art.

DISCLOSURE OF INVENTION

The invention relates to a whirl chamber boiler plant which comprises at least one combustion chamber having boiler tubes therein. The bottom portion of the chamber slopes generally downwardly from the walls thereof toward a generally centrally positioned combustion air inlet means. The invention further comprises means for directing fuel and at least one inert material to the bottom portion of the chamber, and outlet means at the upper portion of the chamber for exit gases and particle products of combustion. Preferably the inert material is in the form of generally grain-shaped particles.

According to the invention the inert material is preferably an ash which is similar to the kind produced by the burning of the fuel. Upon introduction into the chamber, the fuel and hot, inert material are mixed intimately into a mixture which slides downwardly along the sloping bottom towards the air intake. The inert material preheats the fuel to its ignition temperature. Upon coming into contact with the flowing-in combustion air the fuel starts to burn. The exit gases and part of the ash particles leave the combustion chamber at its top though an outlet. The remaining ash particles slide down along the walls of the chamber, give off their heat to the built-in boiler tubes, and at the bottom mix with fresh fuel before again meeting with blown-in combustion air. Thus a whirl is formed in the combustion chamber, having an upwardly directed flow centrally in the chamber and a downwardly directed flow along the chamber walls. The advantage over the fluidbed is achieved by the combustion air inlet having a large cross-section which avoids any blockage and provides only a small pressure drop.

As the exit gases constantly entrain part of the inert material, it is necessary continuously to supply fresh inert material. According to the present invention this may be achieved by providing the combustion chamber at its outlet with a separator, which separates part of the hot ash particles and returns at least part of these to the combustion chamber.

If insufficient material is separated in the separator for maintaining the necessary amount of inert material in the combustion chamber, it may according to the invention be expedient to provide means for returning cold separated ash to the combustion chamber. The cold ash may be ash continuously being separated off before the exit gases are passed out through a chimney, or ash stored for this use.

According to the invention the plant may be equipped with measuring devices for determining the size of the charge in the whirl chamber, so as to decide on the need to return inert material to the combustion chamber and the amount of such material.

The heat released by the combustion is removed and utilized by means of the built-in boiler tubes, which according to the invention may preferably be located along the walls f the combustion chamber, preferably oriented in a vertical direction. Such an arrangement of the boiler tubes ensures that they do not interfere with the whirling movement of the inert material, which movement consists of a central, upwardly directed stream in which the inert material is heated while the added fuel is burned, and a downwardly directed stream along the walls of the combustion chamber, during which movement the inert material gives off its heat to the boiler tubes. Eventually, the inert material is mixed with fresh fuel at the bottom of the chamber.

According to a preferred embodiment, lime or dolomite may be fed along with the fuel in order to remove sulphur oxides. The lime supplied is either fed separately or mixed with the fuel and in doses proportioned to the sulphur content of the fuel.

BRIEF DESCRIPTION OF THE DRAWING

The present invention is described in detail below with reference to the drawing which illustrates a boiler plant having a whirl combustion chamber constructed according to the present invention.

BEST MODE FOR CARRYING OUT THE INVENTION

Referring to the drawing, a boiler or combustion plant including a whirl combustion chamber 1 is shown having an inlet, an outlet, and built-in boiler tubes 2 which serve to conduct away the thermal energy generated during the combustion. Preferably, the boiler tubes are arranged along the walls of the chamber and in a vertical direction. Fuel and an inert, grain-shaped material are led to the bottom 3 of the combustion chamber 1. The bottom 3 slopes downwardly towards a central inlet 4 for passage of combustion air which is indicated by arrow 15. The drawing shows the input of fuel by fuel supply line and arrow 5, and of inert material by inert supply line and arrow 6. A supply line and arrow 7 provides lime for removal of sulphur oxides. The supply lines and arrows 5, 6, and 7 signify only that the respective materials are supplied to the combustion chamber and are not indicative of the exact location in the combustion chamber 1 where the supply lines end. Thus, in the case of coal firing, the addition of lime may occur by adding lime or dolomite in the coal mill so as to feed coal and lime through the same supply tube.

The added inert material, in one embodiment of the present invention is an ash similar to the kind produced by the burning of the fuel. Preferably the inert material has a temperature of combustion above the ignition temperature of the fuel. In this manner the fuel, which is intimately mixed with the inert material during its entry into and passage further downwardly along the inclined bottom of the combustion chamber 1, is evenly distributed and preheated to such a temperature as to start burning upon contact with the blown-in combustion air. The combustion takes place in a whirl which moves upwardly and centrally in the combustion chamber 1 and also downwardly along the walls of the combustion chamber 1. The combustion is preferably controlled in such a way that the hot exiting gases can be conducted away at the top of the combustion chamber 1 through an outlet at a temperature of approximately 700 degrees C. Part of the exiting gases conducted away from the chamber is led to a cyclone 8 through its tangential inlet in which entrained ash particles are separted and are returned through the material outlet 9 of the cyclone to the inert material supply line 6. The exiting gas from the cyclone 8 is, together with any bypassed exiting gas from the outlet, passed in a known manner, as shown in the figure, from the combustion chamber 1 past an economizer 10, and a preheater 11 for combustion air indicated by arrow 15. The preheater 11 is in thermal communication with the combustion air. As shown in the figure, a conduit in communication with the inlet of the combustion chamber 1 passes integrally through the preheater 11 without any mixing of the respective contents therein. The exiting gases further pass to an ash separator 12 through its inlet, in which the remaining ash is separated in a known manner by means of cyclones and electrofilters. From the ash separator 12 and dedusted exiting air is passed to a chimney 13. Also, part of the separated dust may, if desired, be returned through an outlet and through a tube 14 in communication with supply line 6 to the combustion chamber 1 as inert material. Thus it is possible by the addition of cold ash to maintain the required amount of inert material in the combustion chamber 1, should the amount of ash separated in the cyclone 8 prove insufficient. By measuring the pressure drop over the chamber 1 by suitable means (not shown), it may be determined whether the combustion chamber contains the required amount of inert material. Thus the pressure drop measured can be used for controlling the amount of ash to be returned to the combustion chamber 1.

A vane 16 is provided in the conduit coupling the outlet of combustion chamber 1 with the inlet of economizer 10 so as to regulate the flow of exiting gases through the conduit. If desired, the vane 16 can be coupled to and regulated by the pressure measuring means so as to control the flow of ash laden gases passing through the conduit. This in turn, serves to regulate the quantity of both cold and hot ash material which is returned to the combustion chamber 1.

In the drawing, the boiler plant comprises a single combustion chamber. Since the useful gas distribution to be maintained in the chamber may place an upper limit on the size of such a chamber, larger plants can be made of several combustion chambers working in parallel to each other with the combustion being controlled separately in each chamber.

I claim:

1. Whirl chamber boiler plant which comprises at least one combustion chamber having boiler tubes therein, the bottom portion of said chamber sloping generally downwardly from the walls thereof toward generally centrally positioned combustion air inlet means, means for directing fuel and inert material to the bottom portion of said chamber so that the combustion takes place in a whirl which moves upwardly and centrally in said chamber and also downwardly along the walls of said chamber, said inlet means being dimensioned so as to avoid blockage thereof by the inert material, outlet means at the upper portion of said chamber for exit gases and particle products of combustion, means for selectively returning to said chamber at least a first predetermined portion of the inert material from the gases exiting said outlet means of said chamber, and means for returning to said chamber at least a second predetermined portion of the separated ash in a relatively cold condition.

2. The whirl chamber boiler plant according to claim 1 wherein the inert material is generally grain-shaped.

3. The whirl chamber boiler plant according to claim 1 wherein the inclination of the bottom portion of said chamber is such as to allow fuel and inert material to be passed by gravity to the generally central inlet means at the chamber bottom portion such that the fuel contacts the hot inert material and reaches its ignition temperature so as to burn upon contact with the combustion air.

4. The whirl chamber boiler plant according to claim 3 wherein the inert material is grain-shaped ash of the type produced at the burning of the fuel.

5. The whirl chamber boiler plant according to claim 4 further comprising means for separating at least a first predetermined portion of the hot ash particles from the gases exiting said outlet means of said chamber so as to permit returning at least said first predetermined portion thereof to said chamber.

6. The whirl chamber boiler plant according to claim 5 wherein the separating means comprises a cyclone separator having inlet means in communication with the outlet means of said chamber and having outlet means in communication with said means for directing inert material to the bottom portion of said chamber.

7. The whirl chamber boiler plant according to claim 6 further comprising preheating means in communication with the outlet means of said chamber for preheating the combustion air prior to passage through the inlet means of the said chamber.

8. The whirl chamber boiler plant according to claim 7 wherein said preheating means comprises a preheater in communication with the outlet means of said chamber and in thermal communication with the combustion air so as to preheat the combustion air.

9. Whirl chamber boiler plant which comprises at least one combustion chamber having boiler tubes therein, the bottom portion of said chamber sloping generally downwardly from the walls thereof toward generally centrally positioned combustion air inlet means, means for directing fuel and at least one inert material to the bottom portion of said chamber, said inert material being generally grain-shaped ash of the type produced at the burning of the fuel, said inlet means being dimensioned so as to avoid blockage thereof by the inert material, outlet means at the upper portion of said chamber for exit gases and particle products of combustion, means for selectively returning to said chamber at least a first predetermined portion of the inert material from the gases exiting said outlet means of said chamber, wherein the inclination of the bottom portion of said chamber is such as to allow fuel and inert material to be passed by gravity to the generally central inlet means at the chamber bottom portion such that the fuel contacts the hot inert material and reaches its ignition temperature so as to burn upon contact with the combustion air, means for separating at least a first predetermined portion of the hot ash particles from the gases exiting said outlet means of said chamber so as to permit returning at least said first predetermined portion thereof to said chamber, wherein the separating means includes cyclone separator means having inlet means in communication with the outlet means of said chamber and having outlet means in communication with said means for directing inert material to the bottom portion of said chamber, preheating means in communication with the outlet means of said chamber for preheating the combustion air prior to passage through the inlet means of said chamber, said preheating means including a preheater in communication with the outlet means of said chamber and in thermal communication with the combustion air so as to preheat the combustion air, and means for returning to said chamber at least a second predetermined portion of the separated ash in a relatively cold condition after preheating said combustion air.

10. A whirl chamber boiler plant comprising at least one combustion chamber having boiler tubes therein, the bottom portion of said chamber sloping generally downwardly from the walls thereof toward generally centrally positioned combustion air inlet means, means for directing fuel and at least one generally grain-shaped inert material of the type produced at the burning of the fuel to the bottom portion of said chamber, and outlet means at the upper portion of said chamber for exit gases and particle products of combustion, wherein the inclination of the bottom portion of said chamber is such as to allow fuel and inert material to be passed by gravity to the generally central inlet means at the chamber bottom portion such that the fuel contacts the hot inert material and reaches its ignition temperature so as to burn upon contact with the combustion air, means for separating at least a first predetermined portion of the hot ash particles from the gases exiting said outlet means of said chamber so as to permit returning at least said first predetermined portion to said chamber, said separating means including a cyclone separator having inlet means in communication with the outlet means of said chamber and having outlet means in communication with said means for directing inert material to the bottom portion of said chamber, preheating means including a preheater in communication with the outlet means of said chamber and in thermal communication with the combustion air for preheating the combustion air prior to passage through the inlet means of said chamber, means for returning at last a second predetermined portion of the separated ash in a relatively cold condition to said chamber, wherein said means for returning relatively cold separated ash to said chamber includes a separator having inlet means in serial communication with said preheater and the outlet means of the chamber, and having means in communication with the means for directing the inert material to the bottom portion of said chamber.

11. Whirl chamber boiler plant which comprises at least one combustion chamber having boiler tubes therein, the bottom portion of said chamber sloping generally downwardly from the walls thereof toward generally centrally positioned combustion air inlet means, means for directing fuel and at least one inert material to the bottom of said chamber, said inlet means being dimensioned so as to avoid blockage thereof by the inert material, outlet means at the upper portion of said chamber for exit gases and particle products of combustion, means for selectively returning to said chamber at least a first predetermined portion of the inert material from the gases exiting said outlet means of said chamber, and measuring means for determining the size of the charge of inert material in said chamber.

12. The whirl chamber boiler plant according to claim 1 wherein the boiler tubes are arranged generally along the walls of said chamber.

13. The whirl chamber boiler plant according to claim 12 wherein the boiler tubes are arranged in a generally vertical orientation.

14. The whirl chamber boiler plant according to claim 1 wherein at least one of lime and dolomite is supplied along with the fuel.

15. The whirl chamber boiler plant according to claim 1 further comprising means for controlling the combustion within said chamber such that the gases exiting from the outlet means of said chamber has a temperature of about 700 degrees Centigrade.

16. Whirl chamber boiler plant which comprises at least one combustion chamber having a plurality of built-in generally vertically oriented boiler steam tubes, the bottom portion of said chamber sloping generally downwardly from the walls thereof toward a generally centrally positioned combustion air inlet opening, means for directing fuel and at least one inert material such as grain-shaped ash to the bottom portion of said chamber so that the combustion takes place in a whirl which moves upwardly and centrally in said chamber and also downwardly along the walls of said chamber, an outlet opening positioned at the upper portion of said chamber for exit gases and ash particles, means for selectively returning to said chamber at least a first predetermined portion of the inert material from the gases exiting said outlet means of said chamber, and means for selectively returning to said chamber at least a second predetermined portion of the separated ash in a relatively cold condition.

17. A boiler plant for generation of steam which comprises at least one whirl combustion chamber having at least one inlet opening disposed centrally of a bottom end portion thereof, an inlet conduit communicating with said inlet opening for passage of combustion air into said chamber, the bottom end portion of said chamber sloping downwardly from the walls thereof toward the inlet opening, means for supplying fuel and an inert ash type material to the bottom end portion of said chamber, at least one outlet opening disposed at an upper end portion of said chamber, an outlet conduit communicating with the outlet opening for passage of exit gases and ash from said chamber, the inclination of the bottom end portion of said chamber being such as to allow fuel and inert material to be passed by gravity to the inlet opening thereof such that the fuel contacts the hot inert material and reaches its ignition temperature so as to burn upon contact with the combustion air, a first separator communicating with the outlet conduit for receiving a portion of ash laden gases from said chamber and returning a portion of the ash to said chamber, a second separator communicating with the outlet conduit for receiving the remaining portion of ash laden gases from said chamber and communicating with the first separator for receiving the ash laden gases exiting therefrom, the second separator providing for returning a portion of the ash from the ash laden gases entering therein to said chamber, an economizer and a preheater both in serial communication between the outlet conduit and the second separator, the inlet conduit passing integrally through said preheater such that the combustion air is preheated prior to passage of the combustion air through the inlet opening of the chamber, said inlet being dimensioned so as to avoid blockage thereof by the inert ash material.

18. Whirl chamber boiler plant which comprises at least one combustion chamber having boiler tubes therein, the bottom portion of said chamber sloping generally downwardly from the walls thereof toward generally centrally positioned combustion air inlet means, means for directing fuel and at least one inert material to the bottom portion of said chamber such that said inert material will whirl around said combustion chamber without forming a surface and so that the combustion takes place in a whirl which moves upwardly and centrally in said, chamber and also downwardly along the walls of said chamber, outlet means at the upper portion of said chamber for exit gases and particle products of combustion, means for selectively returning to said chamber at least a first predetermined portion of the inert material from the gases exiting said outlet means of said chamber, and means for selectively returning to said chamber at least a second predetermined portion of the separated ash in a relatively cold condition.

19. Whirl chamber boiler plant which comprises at least one combustion chamber having boiler tubes therein, the bottom portion of said chamber sloping generally downwardly from the walls thereof toward generally centrally positioned combustion air inlet means, means for directing fuel and at least one inert material to the bottom portion of said chamber so that the combustion takes place in a whirl which moves upwardly and centrally in said chamber and also downwardly along the walls of said chamber, said inlet means being dimensioned so as to avoid blockage thereof by the inert material, outlet means at the upper portion of said chamber for exit gases and particle products of combustion, means for selectively returning to said chamber at least a first predetermined portion of the inert material from the gases exiting said outlet means of said chamber, and means for selectively returning to said chamber at least a second predetermined portion of the separated ash in a relatively cold condition.

* * * * *

UNITED STATES PATENT AND TRADEMARK OFFICE

CERTIFICATE OF CORRECTION

PATENT NO. : 4,419,964

DATED : December 13, 1983

INVENTOR(S) : Torben Enkegaard

It is certified that error appears in the above-identified patent and that said Letters Patent is hereby corrected as shown below:

On the title page under References Cited U.S. Patent Documents "2,265,465" to Turpin should read --3,265,465--.

In Column 2, line 28, "f" should read --of--.

In Column 3, line 65, "chamber" should read --chamber 1--.

Signed and Sealed this

First Day of May 1984

[SEAL]

*Attest:*

GERALD J. MOSSINGHOFF

*Attesting Officer*

*Commissioner of Patents and Trademarks*